US012428775B2

(12) United States Patent
Wu et al.

(10) Patent No.: US 12,428,775 B2
(45) Date of Patent: Sep. 30, 2025

(54) CLOTHES DRYING DEVICE AND HEAT SUPPLY METHOD THEREFOR

(71) Applicants: QINGDAO HAIER WASHING MACHINE CO., LTD., Shandong (CN); Haier Smart Home Co., Ltd., Shandong (CN)

(72) Inventors: Jun Wu, Qingdao (CN); Wenwei Li, Qingdao (CN); Guangfeng Wang, Qingdao (CN); Yanjuan Niu, Qingdao (CN); Mingliang Yu, Qingdao (CN); Qiuying Gao, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 709 days.

(21) Appl. No.: 17/789,413

(22) PCT Filed: Nov. 16, 2020

(86) PCT No.: PCT/CN2020/129033
§ 371 (c)(1),
(2) Date: Jun. 27, 2022

(87) PCT Pub. No.: WO2021/135686
PCT Pub. Date: Jul. 8, 2021

(65) Prior Publication Data

US 2023/0043093 A1 Feb. 9, 2023

(30) Foreign Application Priority Data

Dec. 30, 2019 (CN) ..... 201911395871.7
Dec. 30, 2019 (CN) ..... 201911399455.4

(51) Int. Cl.
*D06F 58/26* (2006.01)
*D06F 25/00* (2006.01)
(Continued)

(52) U.S. Cl.
CPC ..... *D06F 58/26* (2013.01); *D06F 25/00* (2013.01); *D06F 29/005* (2013.01);
(Continued)

(58) Field of Classification Search
CPC ..... D06F 58/26; D06F 58/38; D06F 58/206; D06F 25/00; D06F 29/005; D06F 95/00; D06F 2105/32
(Continued)

(56) References Cited

U.S. PATENT DOCUMENTS 2,961,776 A * 11/1960 Hughes ..... D06F 34/08 34/607
3,218,730 A * 11/1965 Menk ..... D06F 34/08 34/527
(Continued)

FOREIGN PATENT DOCUMENTS

CN 101517147 A 8/2009
CN 101522979 A 9/2009
(Continued)

OTHER PUBLICATIONS

International Search Report mailed Feb. 19, 2021, in corresponding to International Application No. PCT/CN2020/129033; 6 pages (with English Translation).

*Primary Examiner* — Stephen M Gravini
(74) *Attorney, Agent, or Firm* — Maier & Maier, PLLC

(57) ABSTRACT

A clothes drying device, including an air channel, an air path switching assembly, multiple clothes drying apparatuses, and multiple heating apparatuses. The air path switching assembly includes a first multi-position switching compo-
(Continued)

nent and a second multi-position switching component. The first multi-position switching component and the second multi-position switching component are respectively provided between a hot air input section and intermediate heat source sections and between a hot air output section and the intermediate heat source sections; the first multi-position switching component and the second multi-position switching component have the same number of switching positions and are configured to work in conjunction to each other so that at least one clothes drying apparatus is selectively communicated with the corresponding hot air input section, the hot air output section, and the intermediate heat source sections so as to form a circulation loop.

10 Claims, 2 Drawing Sheets

(51) Int. Cl.

| | |
|---|---|
| ***D06F 29/00*** | (2006.01) |
| ***D06F 58/20*** | (2006.01) |
| ***D06F 58/38*** | (2020.01) |
| ***D06F 95/00*** | (2006.01) |
| ***D06F 105/32*** | (2020.01) |

(52) U.S. Cl.
CPC ..... *D06F 58/206* (2013.01); *D06F 58/38* (2020.02); *D06F 95/00* (2013.01); *D06F 2105/32* (2020.02)

(58) Field of Classification Search
USPC ..... 34/90, 595–610
See application file for complete search history.

(56) References Cited

U.S. PATENT DOCUMENTS

| | | | | |
|---|---|---|---|---|
| 3,555,701 | A | 1/1971 | Hubbard | |
| 5,107,603 | A * | 4/1992 | Durazzani | D06F 58/20 34/604 |
| 5,546,678 | A * | 8/1996 | Dhaemers | F26B 21/02 34/224 |
| 8,266,813 | B2 * | 9/2012 | Grunert | D06F 58/206 68/5 R |
| 10,494,756 | B2 * | 12/2019 | Beers | D06F 58/10 |
| 10,995,448 | B2 * | 5/2021 | Masters | D06F 58/04 |
| 11,866,866 | B2 * | 1/2024 | Rensing | D06F 33/72 |
| 12,180,643 | B2 * | 12/2024 | Wu | D06F 58/38 |
| 12,256,881 | B2 * | 3/2025 | Lee | A61L 2/07 |
| 2007/0119072 | A1 | 5/2007 | Kim | |
| 2022/0380967 | A1 * | 12/2022 | Lee | D06F 58/26 |
| 2023/0043093 | A1 * | 2/2023 | Wu | D06F 95/00 |
| 2023/0175194 | A1 * | 6/2023 | Ryoo | D06F 34/22 34/318 |

FOREIGN PATENT DOCUMENTS

| | | | | |
|---|---|---|---|---|
| CN | 102918198 | A | 2/2013 | |
| CN | 108950976 | A | 12/2018 | |
| CN | 109402985 | A | 3/2019 | |
| EP | 4086382 | A1 * | 11/2022 | D06F 25/00 |
| EP | 4095303 | B1 * | 2/2025 | A61L 2/10 |
| JP | 2023165561 | A * | 11/2023 | |
| WO | WO-2021135686 | A1 * | 7/2021 | D06F 25/00 |

* cited by examiner

CLOTHES DRYING DEVICE AND HEAT SUPPLY METHOD THEREFOR

FIELD

The present disclosure belongs to the technical field of clothing drying, and specifically provides a clothing drying apparatus and a heat supply method therefor.

BACKGROUND

A clothing drying apparatus is an apparatus capable of drying clothing, and common clothing drying apparatuses include a drum clothing dryer, a clothing care machine, a multi-drum clothing dryer, etc.

A patent document with patent No. 201710406151.0 discloses a clothing treatment apparatus, which adopts a drying system that can provide a drying airflow to a first clothing treatment device and a second clothing treatment device respectively or simultaneously; that is, when the first clothing treatment device and the second clothing treatment device are used at the same time, the drying system can only provide the first clothing treatment device and the second clothing treatment device with a drying airflow of the same temperature; moreover, when the first clothing treatment device and the second clothing treatment device are not used at the same time, for example, when the first clothing treatment device is used first, if the second clothing treatment device is desired to be used at this time, it has to wait for the first clothing treatment device to complete clothing treatment; in addition, for each clothing treatment device, it is impossible to achieve different levels of heat supply, and it is impossible to meet the multi-aspect drying requirements of the user.

Accordingly, there is a need in the art for a new clothing drying apparatus to solve the above problem.

SUMMARY

In order to solve the above problem in the first background art, that is, to solve the problem that the existing clothing drying apparatuses cannot meet the multi-aspect drying requirements of the user, the present disclosure provides a clothing drying apparatus, which includes an air duct, an air path switching assembly, a plurality of clothing drying devices and a plurality of heating devices; the air duct includes a plurality of hot air input sections, a plurality of hot air output sections and a plurality of intermediate heat source sections; each of the hot air input sections and each of the hot air output sections are arranged in a one-to-one correspondence with each of the clothing drying devices; each of the intermediate heat source sections is provided with at least one of the heating devices, and the number of the intermediate heat source sections is larger than or equal to the number of the clothing drying devices; the air path switching assembly includes a first multi-position switching member and a second multi-position switching member, which are arranged between the hot air input sections and the intermediate heat source sections as well as between the hot air output sections and the intermediate heat source sections, respectively; the first multi-position switching member and the second multi-position switching member have the same number of switching positions and are arranged to cooperate with each other so as to selectively communicate at least one of the clothing drying devices with the corresponding hot air input section, hot air output section and intermediate heat source section to form a circulation loop; and each of the heating devices is arranged to be capable of being turned on or off independently.

In a preferred technical solution of the above clothing drying apparatus, the plurality of clothing drying devices include a first clothing drying device and a second clothing drying device, and the first multi-position switching member and the second multi-position switching member are a first multi-position switching valve and a second multi-position switching valve respectively.

In a preferred technical solution of the above clothing drying apparatus, the plurality of intermediate heat source sections include a first intermediate heat source section and a second intermediate heat source section, the plurality of heating devices include a first heating device and a second heating device arranged in the first intermediate heat source section and the second intermediate heat source section respectively, and the first multi-position switching valve and the second multi-position switching valve are both three-position switching valves.

In a preferred technical solution of the above clothing drying apparatus, one of the first heating device and the second heating device is a heat pump device, and the other of the first heating device and the second heating device is an electric heating pipe, an electric heating wire or a PTC heater.

In a preferred technical solution of the above clothing drying apparatus, the plurality of intermediate heat source sections include a first intermediate heat source section and a second intermediate heat source section, the plurality of heating devices include at least one first heating device and a plurality of second heating devices arranged in the first intermediate heat source section and the second intermediate heat source section respectively, and the first multi-position switching valve and the second multi-position switching valve are both three-position switching valves.

In a preferred technical solution of the above clothing drying apparatus, the first heating device is at least one of a heat pump device, an electric heating pipe, an electric heating wire and a PTC heater; and/or the plurality of second heating devices are at least two of a heat pump device, an electric heating pipe, an electric heating wire and a PTC heater.

In a preferred technical solution of the above clothing drying apparatus, the plurality of intermediate heat source sections include at least three intermediate heat source sections, the plurality of heating devices include at least one heating device arranged in each of the intermediate heat source sections respectively, and the switching positions of the first multi-position switching valve and the second multi-position switching valve are in a one-to-one correspondence with each of the intermediate heat source sections.

In a preferred technical solution of the above clothing drying apparatus, the plurality of heating devices include a heating device arranged in each of the intermediate heat source sections respectively.

In a preferred technical solution of the above clothing drying apparatus, each of the heating devices is a heat pump device, an electric heating pipe, an electric heating wire or a PTC heater.

In a preferred technical solution of the above clothing drying apparatus, the clothing drying apparatus is a dual-drum clothing dryer, and the first clothing drying device and the second clothing drying device are an upper clothing dryer and a lower clothing dryer that are stacked up and down respectively; or the clothing drying apparatus is a dual-drum washing-drying integrated machine, and the first clothing drying device and the second clothing drying device are an upper washing-drying integrated machine and a lower washing-drying integrated machine that are stacked up and down respectively; or the clothing drying apparatus is a dual-drum mixed machine, and the first clothing drying device and the second clothing drying device are an upper washing-drying integrated machine and a lower clothing dryer that are stacked up and down respectively; or the clothing drying apparatus is a dual-drum mixed machine, and the first clothing drying device and the second clothing drying device are an upper clothing dryer and a lower washing-drying integrated machine that are stacked up and down respectively.

It can be understood by those skilled in the art that in the preferred technical solutions of the present disclosure, a plurality of intermediate heat source sections are provided, each intermediate heat source section is provided with at least one heating device, and the first multi-position switching member and the second multi-position switching member are arranged to cooperate with each other so as to selectively communicate at least one clothing drying device with the corresponding hot air input section, hot air output section and intermediate heat source section to form a circulation loop. Through such an arrangement, as compared with the prior art, on the basis of ensuring that heat can be supplied to different clothing drying devices separately or simultaneously, it is also possible to provide drying airflows of different temperatures to different clothing drying devices; moreover, the start and stop of the clothing drying devices will not affect each other, that is, during the process of drying the clothing by some of the clothing drying devices, some other clothing drying devices can be started at any time to dry the clothing, and when at least two intermediate heat source sections are connected to one clothing drying device at the same time, a drying temperature of this clothing drying device can be controlled by controlling the heating device in each of the connected intermediate heat source section, so as to provide the clothing drying device with different levels of heat supply, meet the multi-aspect drying requirements of the user, and improve the user experience.

Further, the plurality of intermediate heat source sections include a first intermediate heat source section and a second intermediate heat source section, the plurality of heating devices include a first heating device and a second heating device arranged in the first intermediate heat source section and the second intermediate heat source section respectively, and the first multi-position switching valve and the second multi-position switching valve are both three-position switching valves. Through such an arrangement, the first intermediate heat source section and the second intermediate heat source section can communicate with the first clothing drying device at the same time, or the first intermediate heat source section and the second intermediate heat source section can communicate with the second clothing drying device at the same time, or one of the first intermediate heat source section and the second intermediate heat source section communicates with the first clothing drying device, and the other of the first intermediate heat source section and the second intermediate heat source section communicates with the second clothing drying device. As compared with the clothing treatment apparatus disclosed in the patent document with patent No. 201710406151.0, when the drying system in this document only communicates with the first clothing treatment device, it can only provide heat supply from a single heat source (i.e., a fixed heat level) to the first clothing treatment device, whereas when the first clothing drying device of the present disclosure communicates with the first intermediate heat source section and the second intermediate heat source section at the same time, the first heating device in the first intermediate heat source section and the second heating device in the second intermediate heat source section can be used to provide the first clothing drying device with heat supply from a single heat source or a plurality of heat sources, and the heat level is variable. When the drying system in this document communicates with the first clothing treatment device and the second clothing treatment device at the same time, the first clothing treatment device and the second clothing treatment device can be only provided with drying airflows of the same temperature, and if the second clothing treatment device is also desired to perform the drying operation during the drying operation of the first clothing treatment device, it has to wait for the drying operation of the first clothing treatment device to end, whereas when the first clothing drying device of the present disclosure communicates with one of the first intermediate heat source section and the second intermediate heat source section, and the second clothing drying device communicates with the other of the first intermediate heat source section and the second intermediate heat source section, drying airflows of different temperatures can be provided for the first clothing drying device and the second clothing drying device, so that the drying of the first clothing drying device is independent from the drying of the second clothing drying device, and during the drying operation of the first clothing drying device, the second clothing drying device can be started for the drying operation at any time without causing any restriction on the operation of the second clothing drying device; in this way, the multi-aspect drying requirements of the user can be met and the user experience can be improved.

Further, the plurality of intermediate heat source sections include a first intermediate heat source section and a second intermediate heat source section, the plurality of heating devices include at least one first heating device and a plurality of second heating devices arranged in the first intermediate heat source section and the second intermediate heat source section respectively, and the first multi-position switching valve and the second multi-position switching valve are both three-position switching valves. Through such an arrangement, the first intermediate heat source section and the second intermediate heat source section can communicate with the first clothing drying device at the same time, or the first intermediate heat source section and the second intermediate heat source section can communicate with the second clothing drying device at the same time, or one of the first intermediate heat source section and the second intermediate heat source section communicates with the first clothing drying device, and the other of the first intermediate heat source section and the second intermediate heat source section communicates with the second clothing drying device. As compared with the clothing treatment apparatus disclosed in the patent document with patent No. 201710406151.0, when the drying system in this document only communicates with the first clothing treatment device, it can only provide heat supply from a single heat source (i.e., a fixed heat level) to the first clothing treatment device, whereas when the first clothing drying device of the present disclosure communicates with the first intermediate heat source section and the second intermediate heat source section at the same time, the at least one first heating device in the first intermediate heat source section and the plurality of second heating devices in the second intermediate heat source section can be used to provide the first clothing drying device with heat supply from a single heat source or a plurality of heat sources, and the heat level is variable. When the drying system in this document communicates with the first clothing treatment device and the second clothing treatment device at the same time, the first clothing treatment device and the second clothing treatment device can be only provided with drying airflows of the same temperature, and if the second clothing treatment device is also desired to perform the drying operation during the drying operation of the first clothing treatment device, it has to wait for the drying operation of the first clothing treatment device to end, whereas when the first clothing drying device of the present disclosure communicates with one of the first intermediate heat source section and the second intermediate heat source section, and the second clothing drying device communicates with the other of the first intermediate heat source section and the second intermediate heat source section, drying airflows of different temperatures can be provided for the first clothing drying device and the second clothing drying device, so that the drying of the first clothing drying device is independent from the drying of the second clothing drying device, and during the drying operation of the first clothing drying device, the second clothing drying device can be started for the drying operation at any time without causing any restriction on the operation of the second clothing drying device; in this way, the multi-aspect drying requirements of the user can be meet and the user experience can be improved.

Further, the plurality of intermediate heat source sections include at least three intermediate heat source sections, the plurality of heating devices include at least one heating device arranged in each intermediate heat source section respectively, and the switching positions of the first multi-position switching valve and the second multi-position switching valve are in a one-to-one correspondence with each intermediate heat source section. Through such an arrangement, all the intermediate heat source sections can communicate with the first clothing drying device at the same time, or all the intermediate heat source sections can communicate with the second clothing drying device at the same time, or some intermediate heat source sections communicate with the first clothing drying device and some other intermediate heat source sections communicate with the second clothing drying device. As compared with the clothing treatment apparatus disclosed in the patent document with patent No. 201710406151.0, when the drying system in this document only communicates with the first clothing treatment device, it can only provide heat supply from a single heat source (i.e., a fixed heat level) to the first clothing treatment device, whereas when the first clothing drying device of the present disclosure communicates with all the intermediate heat source sections at the same time, the at least one heating device in each intermediate heat source section can be used to provide the first clothing drying device with heat supply from a single heat source or a plurality of heat sources, and the heat level is variable. When the drying system in this document communicates with the first clothing treatment device and the second clothing treatment device at the same time, the first clothing treatment device and the second clothing treatment device can be only provided with drying airflows of the same temperature, and if the second clothing treatment device is also desired to perform the drying operation during the drying operation of the first clothing treatment device, it has to wait for the drying operation of the first clothing treatment device to end, whereas when the first clothing drying device of the present disclosure communicates with some intermediate heat source sections and the second clothing drying device communicates with some other intermediate heat source sections, drying airflows of different temperatures can be provided for the first clothing drying device and the second clothing drying device, so that the drying of the first clothing drying device is independent from the drying of the second clothing drying device, and during the drying operation of the first clothing drying device, the second clothing drying device can be started for the drying operation at any time without causing any restriction on the operation of the second clothing drying device; in this way, the multi-aspect drying requirements of the user can be meet and the user experience can be improved.

Further, the clothing drying apparatus is a dual-drum clothing dryer, and the first clothing drying device and the second clothing drying device are an upper clothing dryer and a lower clothing dryer that are stacked up and down respectively; or the clothing drying apparatus is a dual-drum washing-drying integrated machine, and the first clothing drying device and the second clothing drying device are an upper washing-drying integrated machine and a lower washing-drying integrated machine that are stacked up and down respectively; or the clothing drying apparatus is a dual-drum mixed machine, and the first clothing drying device and the second clothing drying device are an upper washing-drying integrated machine and a lower clothing dryer that are stacked up and down respectively; or the clothing drying apparatus is a dual-drum mixed machine, and the first clothing drying device and the second clothing drying device are an upper clothing dryer and a lower washing-drying integrated machine that are stacked up and down respectively. Through such an arrangement, a vertical space can be fully utilized, so as to avoid occupation of too much horizontal space when placing the dual-drum clothing drying apparatus, and improve a utilization rate of space, so that there is a larger space for the user to place other items, and the user experience is further improved.

DETAILED DESCRIPTION

Figure 1:
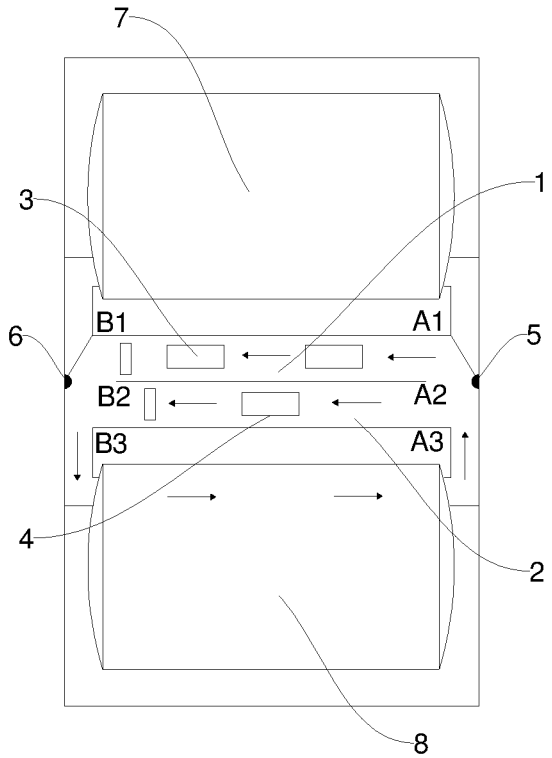
FIG. 1 is a first schematic structural view of a first embodiment of the clothing drying apparatus of the first solution of the present disclosure.

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure.

It should be noted that in the description of the present disclosure, terms indicating directional or positional relationships, such as "intermediate", "upper", "lower", "left", "right", "vertical", "horizontal", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first", "second" and "third" are only used for descriptive purposes, and should not be interpreted as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be internal communication between two elements. For those skilled in the art, the specific meaning of the above terms in the present disclosure can be interpreted according to specific situations.

In view of the problem pointed out in the "BACKGROUND" that the existing clothing drying apparatuses cannot meet the multi-aspect drying requirements of the user, the present disclosure provides a clothing drying apparatus, which aims to meet the multi-aspect drying requirements of the user and improve the user experience.

Specifically, the clothing drying apparatus of the present disclosure includes an air duct, an air path switching assembly, a plurality of clothing drying devices and a plurality of heating devices; the air duct includes a plurality of hot air input sections, a plurality of hot air output sections and a plurality of intermediate heat source sections; each hot air input section and each hot air output section are arranged in a one-to-one correspondence with each clothing drying device; each intermediate heat source section is provided with at least one heating device, and the number of the intermediate heat source sections is larger than or equal to the number of the clothing drying devices; the air path switching assembly includes a first multi-position switching member and a second multi-position switching member, which are arranged between the hot air input sections and the intermediate heat source sections as well as between the hot air output sections and the intermediate heat source sections, respectively; the first multi-position switching member and the second multi-position switching member have the same number of switching positions and are arranged to cooperate with each other so as to selectively communicate at least one clothing drying device with the corresponding hot air input section, hot air output section and intermediate heat source section to form a circulation loop; and each heating device is arranged to be capable of being turned on or off independently. It should be noted that each intermediate heat source section may be provided with only one heating device, or may be provided with a plurality of heating devices; each clothing drying device may communicate with one intermediate heat source section, and may communicate with a plurality of intermediate heat source sections. For example, when the plurality of clothing drying devices include a first clothing drying device and a second clothing drying device and the plurality of intermediate heat source sections include a first intermediate heat source section and a second intermediate heat source section, the first intermediate heat source section may be provided with one heating device, or may be provided with a plurality of heating devices; the second intermediate heat source section may be provided with one heating device, or may be provided with a plurality of heating devices; the first clothing drying device can communicate with the first intermediate heat source section and the second intermediate heat source section at the same time through cooperative actions of the first multi-position switching member and the second multi-position switching member, and similarly, the second clothing drying device can communicate with the first intermediate heat source section and the second intermediate heat source section at the same time through cooperative actions of the first multi-position switching member and the second multi-position switching member. In addition, it is also possible that the first clothing drying device communicates with one of the first intermediate heat source section and the second intermediate heat source section, and the second clothing drying device communicates with the other of the first intermediate heat source section and the second intermediate heat source section. Moreover, it should also be noted that setting the number of the intermediate heat source sections to be larger than or equal to the number of the clothing drying devices is to ensure that when all the clothing drying devices are working at the same time, each clothing drying device can have a corresponding intermediate heat source section connected, thus achieving separate heat supply. In the present disclosure, the first multi-position switching member may adopt a structure of at least one multi-position switching valve (such as a multi-position swing valve or a multi-position ball valve or a combination thereof) or a structure of a combination of multiple on-off valves for realizing multi-position switching; and the second multi-position switching member may adopt a structure of at least one multi-position switching valve (such as a multi-position swing valve or a multi-position ball valve or a combination thereof) or a structure of a combination of multiple on-off valves for realizing multi-position switching. Those skilled in the art can flexibly set the specific structures of the first multi-position switching member and the second multi-position switching member in practical applications. Such adjustments and changes to the specific structures of the first multi-position switching member and the second multi-position switching member do not constitute limitations to the present disclosure, and they should all be defined within the scope of protection of the present disclosure. In addition, at least one fan can be arranged in each intermediate heat source section, so as to ensure that the fan can drive the air in the corresponding intermediate heat source section to flow. Of course, it is also possible to arrange a large fan between the hot air input section and the intermediate heat source sections and/or between the hot air output section and the intermediate heat source sections, and this large fan is used to drive the air in all the intermediate heat source sections to flow at the same time. Those skilled in the art can flexibly set the number of fans and the arrangement thereof in practical applications, as long as the air in the intermediate heat source sections can flow under the action of the fans, so that a circulating wind is formed in a circulation loop formed by the clothing drying devices and the corresponding hot air input section, hot air output section and intermediate heat source sections to realize the drying of the clothing in the clothing drying devices.

Preferably, the plurality of clothing drying devices include a first clothing drying device and a second clothing drying device, and the first multi-position switching member and the second multi-position switching member are a first multi-position switching valve and a second multi-position switching valve respectively (i.e., the first multi-position switching member is the first multi-position switching valve and the second multi-position switching member is the second multi-position switching valve). The clothing drying apparatus may be a dual-drum clothing dryer, and the first clothing drying device and the second clothing drying device are an upper clothing dryer and a lower clothing dryer that are stacked up and down, respectively; of course, the first clothing drying device and the second clothing drying device may also be a left clothing dryer and a right clothing dryer arranged side by side, respectively. In addition, the clothing drying apparatus may also be a dual-drum washing-drying integrated machine, and the first clothing drying device and the second clothing drying device are an upper washing-drying integrated machine and a lower washing-drying integrated machine that are stacked up and down respectively (which can also be replaced with a left washing-drying integrated machine and a right washing-drying integrated machine); or the clothing drying apparatus is a dual-drum mixed machine, and the first clothing drying device and the second clothing drying device are an upper washing-drying integrated machine and a lower clothing dryer that are stacked up and down respectively (which can also be replaced with a left washing-drying integrated machine and a right clothing dryer); or the clothing drying apparatus is a dual-drum mixed machine, and the first clothing drying device and the second clothing drying device are an upper clothing dryer and a lower washing-drying integrated machine that are stacked up and down respectively (which can also be replaced with a left clothing dryer and a right washing-drying integrated machine). Moreover, the clothing drying apparatus may also be a clothing care machine with two drying chambers, and the first clothing drying device and the second clothing drying device are an upper clothing care machine with a first drying chamber and a lower clothing care machine with a second drying chamber, respectively. Of course, the upper clothing care machine and the lower clothing care machine may also be replaced with a left clothing care machine and a right clothing care machine. Both the first multi-position switching valve and the second multi-position switching valve may include a drive motor and a valve plate. An output shaft of the drive motor is connected with the valve plate and can drive the valve plate to rotate relative to the output shaft of the motor. The drive motor can drive the valve plate to rotate to different switching positions to realize switching of the air path. Those skilled in the art can flexibly set the specific structures of the first multi-position switching valve and the second multi-position switching valve in practical applications. Such adjustments and changes to the specific structure of the first multi-position switching valve do not constitute limitations to the present disclosure, and they should all be defined within the scope of protection of the present disclosure.

The technical solution of the present disclosure will be further described below in connection with three embodiments.

First Embodiment

Figure 2:
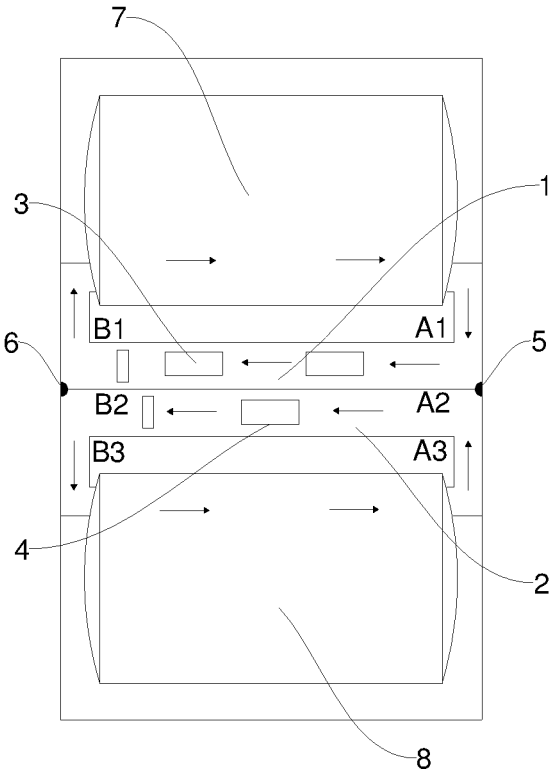
FIG. 2 is a second schematic structural view of the first embodiment of the clothing drying apparatus of the first solution of the present disclosure.
Figure 3:
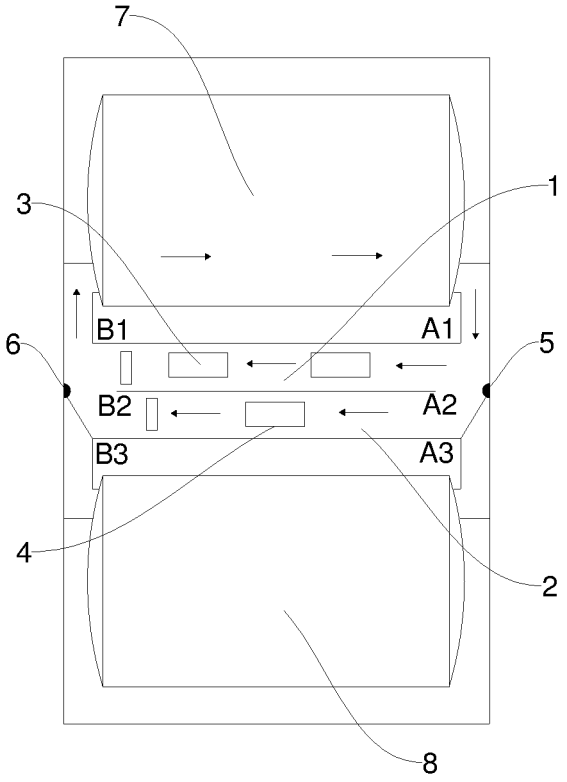
FIG. 3 is a third schematic structural view of the first embodiment of the clothing drying apparatus of the first solution of the present disclosure.

As shown in FIGS. 1 to 3, the plurality of intermediate heat source sections include a first intermediate heat source section 1 and a second intermediate heat source section 2; the plurality of heating devices include a first heating device 3 and a second heating device 4 arranged in the first intermediate heat source section 1 and the second intermediate heat source section 2 respectively; and both the first multi-position switching valve 5 and the second multi-position switching valve 6 are three-position switching valves. The three valve positions of the first multi-position switching valve 5 are A1, A2 and A3 respectively, and the three valve positions of the second multi-position switching valve 6 are B1, B2 and B3 respectively. Taking the structure shown in FIGS. 1 to 3 as an example, when the first multi-position switching valve 5 is in the valve position A1 and the second multi-position switching valve 6 is in the valve position B1 (see FIG. 1), both the first intermediate heat source section 1 and the second intermediate heat source section 2 are connected to the second clothing drying device 8; that is, an inlet of the first intermediate heat source section 1 and an inlet of the second intermediate heat source section 2 both communicate with the hot air output section corresponding to the second clothing drying device 8, and an outlet of the first intermediate heat source section 1 and an outlet of the second intermediate heat source section 2 both communicate with the hot air input section corresponding to the second clothing drying device 8. When the first multi-position switching valve 5 is in the valve position A2 and the second multi-position switching valve 6 is in the valve position B2 (see FIG. 2), the first intermediate heat source section 1 is connected to the first clothing drying device 7 and the second intermediate heat source section 2 is connected to the second clothing drying device 8; that is, the inlet of the first intermediate heat source section 1 communicates with the hot air output section corresponding to the first clothing drying device 7, the inlet of the second intermediate heat source section 2 communicates with the hot air output section corresponding to the second clothing drying device 8, the outlet of the first intermediate heat source section 1 communicates with the hot air input section corresponding to the first clothing drying device 7, and the outlet of the second intermediate heat source section 2 communicates with the hot air input section corresponding to the second clothing drying device 8. When the first multi-position switching valve 5 is in the valve position A3 and the second multi-position switching valve 6 is in the valve position B3 (see FIG. 3), both the first intermediate heat source section 1 and the second intermediate heat source section 2 are connected to the first clothing drying device 7; that is, the inlet of the first intermediate heat source section 1 and the inlet of the second intermediate heat source section 2 both communicate with the hot air output section corresponding to the first clothing drying device 7, and the outlet of the first intermediate heat source section 1 and the outlet of the second intermediate heat source section 2 both communicate with the hot air input section corresponding to the first clothing drying device 7. When both the first intermediate heat source section 1 and the second intermediate heat source section 2 are connected to the second clothing drying device 8, the first heating device 3 and the second heating device 4 can simultaneously supply heat to the second clothing drying device 8, namely, dual-heat-source heat supply; of course, it is also possible to supply heat to the second clothing drying device 8 only through the first heating device 3 or the second heating device 4, namely, single-heat-source heat supply, so as to adjust the heat level of the second clothing drying device 8. When both the first intermediate heat source section 1 and the second intermediate heat source section 2 are connected to the first clothing drying device 7, the first heating device 3 and the second heating device 4 can simultaneously supply heat to the first clothing drying device 7, namely, dual-heat-source heat supply; of course, it is also possible to supply heat to the first clothing drying device 7 only through the first heating device 3 or the second heating device 4, namely, single-heat-source heat supply, so as to adjust the heat level of the first clothing drying device 7. When the first intermediate heat source section 1 is connected to the first clothing drying device 7 (i.e., the first heating device 3 supplies heat to the first clothing drying device 7) and the second intermediate heat source section 2 is connected to the second clothing drying device 8 (i.e., the second heating device 4 supplies heat to the second clothing drying device 8), the first clothing drying device 7 and the second clothing drying device 8 can be supplied with heat respectively, and there is no mutual restriction between the time of turning on or off the first clothing drying device 7 and the time of turning on or off the second clothing drying device 8; that is, the second clothing drying device 8 can be turned on at any time during the operation of the first clothing drying device 7, and the first clothing drying device 7 can be turned on at any time during the operation of the second clothing drying device 8. The drying airflow provided by the first heating device 3 to the first clothing drying device 7 can have a different temperature from the drying airflow provided by the second heating device 4 to the second clothing drying device 8.

In the above, the first heating device 3 may be a heat pump device, an electric heating pipe, an electric heating wire or a PTC heater; similarly, the second heating device 4 may be a heat pump device, an electric heating pipe, an electric heating wire or a PTC heater. Those skilled in the art can flexibly set the specific structures of the first heating device 3 and the second heating device 4 in practical applications. Such adjustments and changes to the specific structures of the first heating device 3 and the second heating device 4 do not constitute limitations to the present disclosure, and they should all be defined within the scope of protection of the present disclosure. In a possible situation, the first heating device 3 is a heat pump device, and the heat pump device includes an evaporator, a condenser and a compressor that constitute a refrigerant circulation loop. The evaporator and the condenser are both arranged in the first intermediate heat source section 1, and the evaporator is located on an upstream side of the condenser in the flow direction of the air. The evaporator is configured to dehumidify the air, and the condenser is configured to heat the air.

Second Embodiment

The plurality of intermediate heat source sections include a first intermediate heat source section and a second intermediate heat source section, the plurality of heating devices include at least one first heating device and a plurality of second heating devices arranged in the first intermediate heat source section and the second intermediate heat source section respectively, and the first multi-position switching valve and the second multi-position switching valve are both three-position switching valves. Different from the first embodiment, the first heating device in the first intermediate heat source section may be one, or may be plural, and the second heating devices in the second intermediate heat source section is plural. Taking one first heating device and a plurality of second heating devices as an example, when both the first intermediate heat source section and the second intermediate heat source section are connected to the first clothing drying device or the second clothing drying device, the plurality of second heating device can be all turned off, or all turned on, or part of them are turned on and the other part of them are turned off, which can be specifically adjusted flexibly according to the heat level required by the user. When the first intermediate heat source section is connected to one of the first clothing drying device and the second clothing drying device and the second intermediate heat source section is connected to the other of the first clothing drying device and the second clothing drying device, the plurality of second heating devices may be all turned on, or part of them are turned on and the other part of them are turned off, so that the drying device connected to the second intermediate heat source section can adjust the heat level.

In the above, the first heating device is at least one of a heat pump device, an electric heating pipe, an electric heating wire and a PTC heater; and/or the plurality of second heating devices are at least two of a heat pump device, an electric heating pipe, an electric heating wire and a PTC heater. That is, each second heating device may be a heat pump device, an electric heating pipe, an electric heating wire, or a PTC heater. Those skilled in the art can flexibly set the specific structures of the first heating device and the second heating device in practical applications. Such adjustments and changes to the specific structures of the first heating device and the second heating device do not constitute limitations to the present disclosure, and they should all be defined within the scope of protection of the present disclosure.

Third Embodiment

The plurality of intermediate heat source sections include at least three intermediate heat source sections, the plurality of heating devices include at least one heating device arranged in each intermediate heat source section respectively, and the switching positions of the first multi-position switching valve and the second multi-position switching valve are in a one-to-one correspondence with each intermediate heat source section. Different from the first embodiment, the number of the intermediate heat source sections is at least three, and the heating device in each intermediate heat source section may be one, or may be plural. Taking the number of the intermediate heat source sections being three as an example, the intermediate heat source sections are a first intermediate heat source section, a second intermediate heat source section and a third intermediate heat source section respectively; the first multi-position switching valve and the second multi-position switching valve each have four valve positions, so that the switching positions of the first multi-position switching valve and the second multi-position switching valve are in a one-to-one correspondence with each intermediate heat source section (it should be noted that the one-to-one correspondence herein does not mean that the number of switching positions are in a one-to-one correspondence with the number of the intermediate heat source sections, but means that the number of switching positions are in a one-to-one correspondence with the number of channel boundaries formed by all the intermediate heat source sections; for example, the number of channel boundaries formed by three intermediate heat source sections is four, so the number of switching positions corresponding to the three intermediate heat source sections is four, whereas the number of channel boundaries formed by the two intermediate heat source sections in the first and second embodiments is three, so the number of switching positions corresponding to the two intermediate heat source sections is three). The four valve positions of the first multi-position switching valve are A1, A2, A3 and A4 respectively, and the four valve positions of the second multi-position switching valve are B1, B2, B3 and B4. In a possible situation, when the first multi-position switching valve is in the valve position A1 and the second multi-position switching valve is in the valve position B1, the first intermediate heat source section, the second intermediate heat source section and the third intermediate heat source section are all connected to the second clothing drying device, that is, an inlet of the first intermediate heat source section, an inlet of the second intermediate heat source section and an inlet of the third intermediate heat source section all communicate with the hot air output section corresponding to the second clothing drying device, and an outlet of the first intermediate heat source section, an outlet of the second intermediate heat source section and an outlet of the third intermediate heat source section all communicate with the hot air input section corresponding to the second clothing drying device. When the first multi-position switching valve is in the valve position A2 and the second multi-position switching valve is in the valve position B2, the first intermediate heat source section is connected to the first clothing drying device, and the second intermediate heat source section and the third intermediate heat source section are connected to the second clothing drying device, that is, the inlet of the first intermediate heat source section communicates with the hot air output section corresponding to the first clothing drying device, and the inlet of the second intermediate heat source section and the inlet of the third intermediate heat source section both communicate with the hot air output section corresponding to the second clothing drying device; the outlet of the first intermediate heat source section communicates with the hot air input section corresponding to the first clothing drying device, and the outlet of the second intermediate heat source section and the outlet of the third intermediate heat source section both communicate with the hot air input section corresponding to the second clothing drying device. When the first multi-position switching valve is in the valve position A3 and the second multi-position switching valve is in the valve position B3, the first intermediate heat source section and the second intermediate heat source section are connected to the first clothing drying device, and the third intermediate heat source section is connected to the second clothing drying device, that is, the inlet of the first intermediate heat source section and the inlet of the second intermediate heat source section both communicate with the hot air output section corresponding to the first clothing drying device, and the inlet of the third intermediate heat source section communicates with the hot air output section corresponding to the second clothing drying device; the outlet of the first intermediate heat source section and the outlet of the second intermediate heat source section both communicate with the hot air input section corresponding to the first clothing drying device, and the outlet of the third intermediate heat source section communicates with the hot air input section corresponding to the second clothing drying device. When the first multi-position switching valve is in the valve position A4 and the second multi-position switching valve is in the valve position B4, the first intermediate heat source section, the second intermediate heat source section and the third intermediate heat source section are all connected to the first clothing drying device, that is, the inlet of the first intermediate heat source section, the inlet of the second intermediate heat source section and the inlet of the third intermediate heat source section all communicate with the hot air output section corresponding to the first clothing drying device, and the outlet of the first intermediate heat source section, the outlet of the second intermediate heat source section and the outlet of the third intermediate heat source section all communicate with the hot air input section corresponding to the first clothing drying device.

In the above, the plurality of heating devices include each one heating device arranged in each of the intermediate heat source sections respectively. Each heating device is a heat pump device, an electric heating pipe, an electric heating wire or a PTC heater. Those skilled in the art can flexibly set the specific structure of each heating device in practical applications. Such adjustments and changes to the specific structures of each heating device do not constitute limitations to the present disclosure, and they should all be defined within the scope of protection of the present disclosure.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features. All these technical solutions after such changes or replacements will fall within the scope of protection of the present disclosure.

What is claimed is:

1. A clothing drying apparatus, comprising: an air duct, an air path switching assembly, a plurality of clothing drying devices and a plurality of heating devices;

the air duct comprises a plurality of hot air input sections, a plurality of hot air output sections and a plurality of intermediate heat source sections; each of the hot air input sections and each of the hot air output sections are arranged in a one-to-one correspondence with each of the clothing drying devices; each of the intermediate heat source sections is provided with at least one of the heating devices, and a number of the intermediate heat source sections is larger than or equal to a number of the clothing drying devices;

the air path switching assembly comprises a first multi-position switching member and a second multi-position switching member, which are arranged between the hot air input sections and the intermediate heat source sections as well as between the hot air output sections and the intermediate heat source sections, respectively; the first multi-position switching member and the second multi-position switching member have an identical number of switching positions and are arranged to cooperate with each other so as to selectively communicate at least one of the clothing drying devices with a corresponding hot air input section, a corresponding hot air output section and a corresponding intermediate heat source section to form a circulation loop; and each of the heating devices is configured to be turned on or off independently.

2. The clothing drying apparatus according to claim 1, wherein the plurality of clothing drying devices comprise a first clothing drying device and a second clothing drying device, and the first multi-position switching member and the second multi-position switching member are a first multi-position switching valve and a second multi-position switching valve, respectively.

3. The clothing drying apparatus according to claim 2, wherein the plurality of intermediate heat source sections comprise a first intermediate heat source section and a second intermediate heat source section, the plurality of heating devices comprise a first heating device and a second heating device arranged in the first intermediate heat source section and the second intermediate heat source section, respectively, and the first multi-position switching valve and the second multi-position switching valve are both three-position switching valves.

4. The clothing drying apparatus according to claim 3, wherein one of the first heating device and the second heating device is a heat pump device, and the remaining one of the first heating device and the second heating device is an electric heating pipe, an electric heating wire or a PTC heater.

5. The clothing drying apparatus according to claim 2, wherein the plurality of intermediate heat source sections comprise a first intermediate heat source section and a second intermediate heat source section, the plurality of heating devices comprise at least one first heating device and a plurality of second heating devices arranged in the first intermediate heat source section and the second intermediate heat source section, respectively, and the first multi-position switching valve and the second multi-position switching valve are both three-position switching valves.

6. The clothing drying apparatus according to claim 5, wherein the first heating device is at least one of a heat pump device, an electric heating pipe, an electric heating wire and a PTC heater; and/or the plurality of second heating devices comprise at least two of a heat pump device, an electric heating pipe, an electric heating wire and a PTC heater.

7. The clothing drying apparatus according to claim 2, wherein the plurality of intermediate heat source sections comprise at least three intermediate heat source sections, the plurality of heating devices comprise at least one heating device arranged in each of the intermediate heat source sections, respectively, and switching positions of the first multi-position switching valve and the second multi-position switching valve are in a one-to-one correspondence with each of the intermediate heat source sections.

8. The clothing drying apparatus according to claim 7, wherein the plurality of heating devices comprise a heating device arranged in each of the intermediate heat source sections, respectively.

9. The clothing drying apparatus according to claim 8, wherein each of the heating devices is a heat pump device, an electric heating pipe, an electric heating wire or a PTC heater.

10. The clothing drying apparatus according to claim 2, wherein the clothing drying apparatus is a dual-drum clothing dryer, and the first clothing drying device and the second clothing drying device are an upper clothing dryer and a lower clothing dryer that are stacked up and down, respectively; or the clothing drying apparatus is a dual-drum washing-drying integrated machine, and the first clothing drying device and the second clothing drying device are an upper washing-drying integrated machine and a lower washing-drying integrated machine that are stacked up and down, respectively; or the clothing drying apparatus is a dual-drum mixed machine, and the first clothing drying device and the second clothing drying device are an upper washing-drying integrated machine and a lower clothing dryer that are stacked up and down, respectively; or the clothing drying apparatus is a dual-drum mixed machine, and the first clothing drying device and the second clothing drying device are an upper clothing dryer and a lower washing-drying integrated machine that are stacked up and down, respectively.

* * * * *